US008359809B1

(12) United States Patent
Erickson

(10) Patent No.: US 8,359,809 B1
(45) Date of Patent: Jan. 29, 2013

(54) APPARATUS AND METHOD FOR REFURBISHING A WORK STATION

(76) Inventor: Scott Erickson, Lakeville, MN (US)

( * ) Notice: Subject to any disclaimer, the term of this patent is extended or adjusted under 35 U.S.C. 154(b) by 11 days.

(21) Appl. No.: 12/789,842

(22) Filed: May 28, 2010

Related U.S. Application Data

(60) Provisional application No. 61/182,336, filed on May 29, 2009.

(51) Int. Cl.
*E04B 1/00* (2006.01)

(52) U.S. Cl. ..... 52/745.1; 52/36.5; 52/239; 52/242

(58) Field of Classification Search ..... 52/36.5, 52/36.4, 239, 238.1, 242, 745.1, 243, 243.1, 52/716.2, 716.3, 716.4; 108/106–110
See application file for complete search history.

(56) References Cited

U.S. PATENT DOCUMENTS 4,391,073 A * 7/1983 Mollenkopf et al. ..... 52/241
5,363,612 A * 11/1994 Erickson ..... 52/239
6,141,926 A * 11/2000 Rossiter et al. ..... 52/239
6,161,347 A * 12/2000 Yu et al. ..... 52/220.7
6,230,445 B1 * 5/2001 Arko et al. ..... 52/36.5
6,493,995 B2 * 12/2002 McKenzie ..... 52/36.4
6,742,307 B2 * 6/2004 Briskman ..... 52/36.1
6,775,953 B2 * 8/2004 Burken et al. ..... 52/481.2
6,920,727 B2 * 7/2005 Yu et al. ..... 52/239
7,150,127 B2 * 12/2006 Underwood et al. ..... 52/36.1
2003/0213193 A1 * 11/2003 Carroll et al. ..... 52/238.1

* cited by examiner

*Primary Examiner* — William Gilbert
*Assistant Examiner* — Gisele Ford
(74) *Attorney, Agent, or Firm* — Moore & Hansen, PLLC

(57) ABSTRACT

An apparatus and method of refurbishing a modular work station or cubicle having a wall segment with at least one exterior surface and at least one horizontal load support that is connected to the wall segment so that it confronts the exterior surface. The apparatus includes one or more sheets of material that can be trimmed to the dimensions of the exterior surface and which are thin enough so that they are able to be inserted between a load support (such as a desk top, tack board, shelf, tool rail, cabinet, or the like) and the external surface. The one or more sheets can be penetrable (tackable), paramagnetic, and/or capable of use with wet or dry markers. The one or more sheets may also be provided with a finishing layer of woven material or fabric and can be fire resistant and/or have acoustical dampening properties.

20 Claims, 4 Drawing Sheets

APPARATUS AND METHOD FOR REFURBISHING A WORK STATION

RELATED APPLICATIONS

The current application claims benefit under 35 U.S.C. §119(e) of U.S. provisional application No. 61/182,336 filed May 29, 2009, the disclosure of which is herein incorporated by reference in its entirety.

BACKGROUND

This application relates generally to modular office work stations. More particularly, this application relates to refurbishing modular work stations and the like. Modular work stations, i.e. cubicles are ubiquitous in today's modern office. They are functional, modular, decorative, and provide a measure of privacy. Modern work stations can be quite simple or they can be quite elaborate, but they all usually have the same basic features. That is, they comprise vertical wall segments that can be connected to each other to form a partial, doorless enclosure, or cubicle. These wall segments usually include electrical and telephonic outlets that are received within internal raceways, and the internal raceways of one wall segment are usually in communication with internal raceways of adjacent, interconnected wall segments so that a plurality of cubicles can be electrically wired in a manner similar to normal building construction. In addition, wall segments are usually provided with horizontal load support surfaces, for example, desk tops, overhead shelving and storage cabinets. These support surfaces are usually bolted directly to, or otherwise rigidly attached to the wall segments so that they are able to support loads and meet building codes. Cubicle structures may also be provided with lateral and horizontal file cabinets that also may be connected to one or more wall segments. When the cubicle structure is finally assembled, it can be quite substantial and can often be considered semi-permanent.

As will be appreciated, most cubicles, once they have been assembled, are not easily changed or rearranged. Usually, when the owner of the cubicles wants to change the look and feel of the cubicles, all of the cubicles are replaced. This, however, can be expensive and time consuming. New cubicles and components have to be selected and agreed upon; changes to the locations of the new cubicles have to be determined; the users of the cubicles must remove all personal possessions from their cubicle and place them into storage; the old cubicles need to be dismantled and carted away; and the new cubicles need to be trucked in and assembled, where assembly includes wiring, attaching work surfaces, storage shelves, cabinets, etcetera. The users of the cubicles then have to remove their items from storage and transfer them to the new cubicles, etcetera. As one can imagine, this is expensive and consumes an inordinate amount of time.

An alternative and less expensive approach is to refurbish the cubicles. With refurbishing, some of the costs and steps associated with outright replacement are avoided. However, many of the costs and steps associated with outright replacement are retained. That is, the users of the cubicles have to remove all items from their work spaces and cubicles need to be dismantled before the wall segments can be refurbished. More particularly, employees must unload storage cabinets, overhead storage units, drawers and files from their work area. Specialists must come in and remove the existing networking hardware such as computers, electrical wiring and cords, telephones, etc. Then, professional installers are brought in to disassemble the cubicle system completely, and every component must be dismantled or broken down and the cubicle panels must have side edges and top caps removed (all this before refurbishing begins). The old exterior surface is then removed and a new exterior surface is installed, at which point the side edges and the top caps are reinstalled. The wall segments must then be reattached to each other, leveled and have the power and other networking hardware reconnected. Then the storage cabinets, overhead storage units, tool rails, accessories, lights, filing, etc. are reinstalled and leveled. The specialists (technicians) then reinstall the computer and phone systems. Finally, the employee must unpack their personal items and files and put them into their refurbished cubicle.

The present disclosure addresses problems and limitations associated with current work station refurbishing.

SUMMARY

In one embodiment, an apparatus for refurbishing a cubicle comprises a single thin sheet or substrate of material that is trimmed so that it is substantially equal to, or less than, the size of the wall segment to which it is going to be used. The sheet (or substrate) may be covered with an optional, finishing layer of material that may be fire retardant, that may have acoustical dampening properties, and which may be penetrable (tackable) so as to be able to receive push-pins or the like. Alternatively, the sheet (or substrate) may be paramagnetic, capable of use with dry or wet markers, or combinations of penetrability, paramagnetism and marking receiving material.

The sheet (or substrate) comprises material is thin enough to be able to be inserted between an interior surface a wall segment and a wall segment accessory such as a horizontal load support, tack board, tool rail, cabinet, etc. In addition, the sheet or substrate is thick enough so that it can support the optional finishing layer of primary material and/or secondary material such as calendars, photos, memos, notes, etc, which are removably affixed thereto. Preferably the sheet or substrate is attached to an existing wall segment by way of one or more fasteners such as double sided adhesive tape, staples, tacks, barbed attachment clips and/or construction adhesive.

In another embodiment, the apparatus may comprise a plurality of sheets that are able to effectively cover an existing wall segment. Preferably, the sheets compliment each other so that together and extend substantially along either the width or length dimensions of each wall segment to which they are attached. As with the previous embodiment, the sheet or substrates are thick enough so that they can support optional finishing layers of primary material and/or secondary material such as calendars, photos, memos, notes, etc., which are removably affixed thereto. In addition, the sheets or substrates may be attached to the existing wall segment by way of one or more fasteners such as double-sided adhesive tape, staples, tacks, barbed attachment clips and/or construction adhesive.

The apparatus and preferred methods of use allows a work station or cubicle to be refurbished in a straightforward manner without the need for dismantling all of the structural components of the cubicle. The apparatus and preferred methods of use allows a work station or cubicle to be refurbished without the need to change, remove, or rewire existing electrical and/or communication pathways. The apparatus and methods of use allows a work station or cubicle to be refurbished with a minimum of disruption to the occupant of the cubicle. And the apparatus and methods of use allows a work station or cubicle to be refurbished in-situ.

These and other features and advantages will appear more fully from the following description, made in conjunction with the accompanying drawings wherein like reference characters refer to the same or similar parts throughout the several views. And, although the disclosure hereof is detailed and exact, the physical embodiments herein disclosed are merely examples that may be embodied in other specific structures. While preferred embodiments have been described, the details may be changed without departing from the claims.

DETAILED DESCRIPTION

Figure 1:
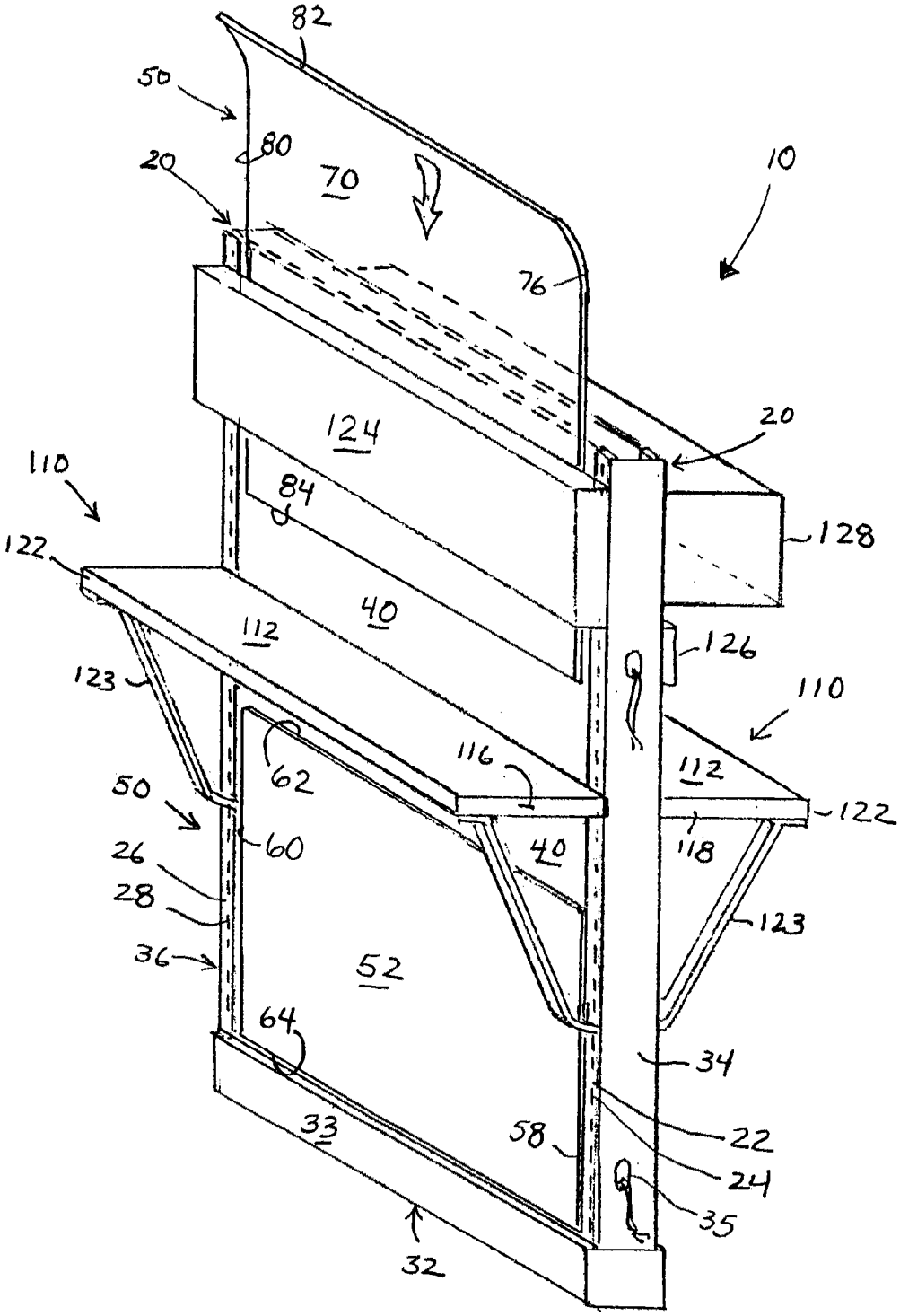
FIG. 1 is a perspective representation of an embodiment of the apparatus and method for refurbishing a work station.
Figure 2:
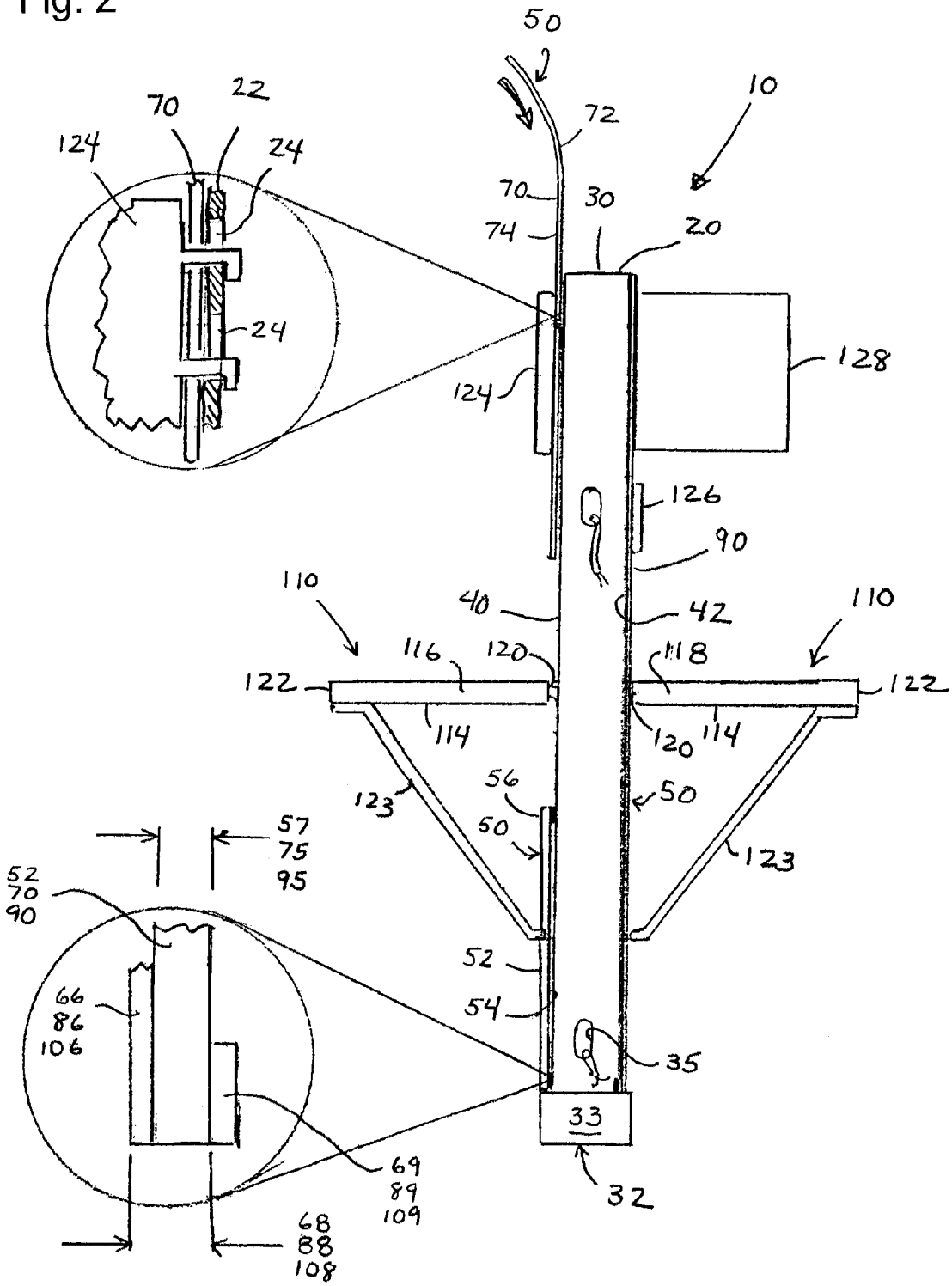
FIG. 2 is a side elevational view of the apparatus and work station of FIG. 1.
Figure 3:
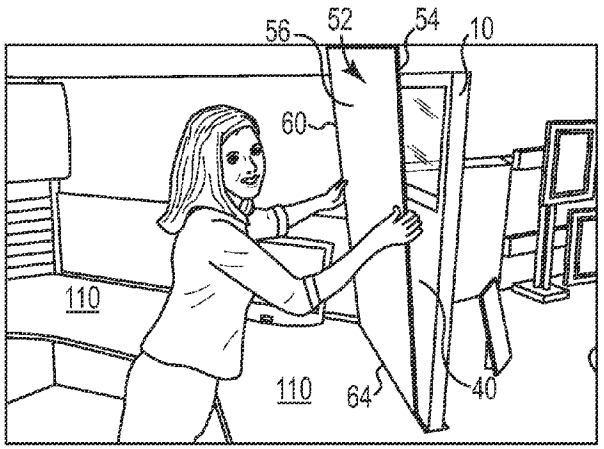
FIG. 3 is an illustration of an interior, vertical wall segment and an embodiment of a first refurbishing sheet, prior to installation to the wall segment.
Figure 4:
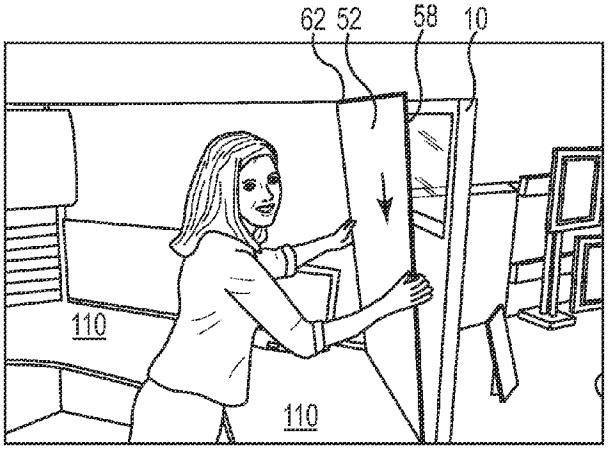
FIG. 4 is an illustration of the interior, vertical wall segment and the first refurbishing sheet of FIG. 3, wherein the first sheet is partially inserted between the vertical wall segment and a horizontal work surface.
Figure 5:
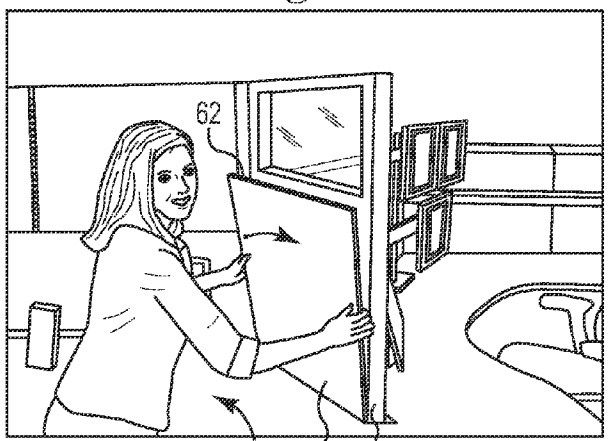
FIG. 5 is an illustration of the interior, vertical wall segment and the first refurbishing sheet of FIG. 4, wherein the first sheet has been fully inserted between the vertical wall segment and the horizontal work surface, and prior to affixing the top of the first refurbishing sheet to the vertical wall segment.
Figure 6:
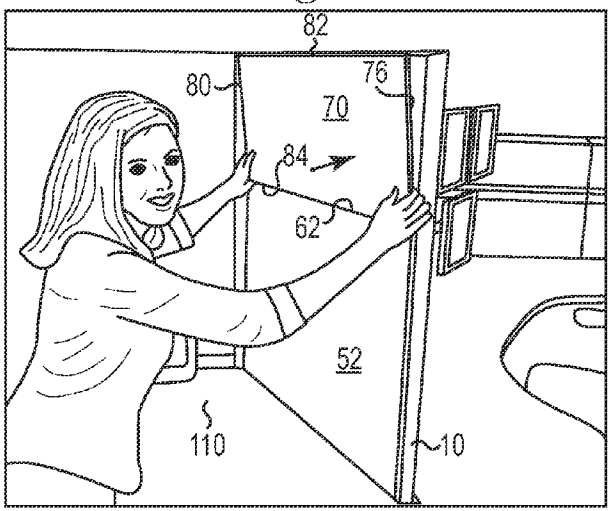
FIG. 6 is an illustration of the interior, vertical wall segment and the first refurbishing sheet of FIG. 5 and an embodiment of a second refurbishing sheet being positioned above the first refurbishing sheet and prior to affixing the second refurbishing sheet to the vertical, wall segment; and, FIG. 7 is a depiction of an embodiment of the apparatus as it is being used to refurbish an interior surface of a work station, wherein a first refurbishing sheet is being positioned behind an existing vertical support such as a tack board.

Referring to FIGS. 1 and 2, one embodiment, an apparatus for refurbishing a cubicle comprises a thin sheet or substrate of material that is trimmed so that it is substantially equal to, or less than, the size of the wall segment to which it is going to be used. As shown, a typical work station or cubicle includes at least one wall segment 10 having a rectangular frame 20 that includes side margins 22, 26 having attachment slots 24, 28, a top 30, a bottom 32 with a baseboard 33, and side edges 34, 36. The attachment slots 24, 28 are configured to receive hooks that extend from accessories such as a horizontal load supports, tack boards, tool rails, overhead cabinets, etc. (see, upper inset of FIG. 2). The typical wall segment 10 also includes external surfaces 40 and 42 that are the objects of refurbishment. Note that each of the external surfaces 40, 42 of the wall segment 10 may face outwardly and/or inwardly with respect to a single work station or cubicle. Alternatively, the wall segment 10 may be used as a common wall between work stations, so that each exterior surface 40, 42 forms an inwardly facing wall of an adjacent work station.

The apparatus 50 of this preferred embodiment includes one or more sheets or substrates 52, 70, 90 with each having a first surface, a second surface, side edges, a top edge and a bottom edge. As depicted in FIGS. 1 and 2, the exterior surface 40 is on the left side and the exterior surface 42 is on the right side. The left side of the wall segment 10 has a horizontal work surface 110 that has a top 112, a bottom 114, side edges 116, 118, an inner facing edge 120 and an outer facing edge 122. The work surface 110 is removably attached to the wall segment frame 20 by hooks that fit into slots 24, 28 at the sides 22, 26 of the frame 20, and braces 123 that support the work surface 110 from below. Above the work surface 110 is a tack board 124 that is removably attached to the wall segment by hooks that fit into slots 24, 28 at the sides 22, 26 of the wall segment frame 20. The right side of the wall segment 10 has a horizontal work surface 110 that has a top 112, a bottom 114, side edges 116, 118, an inner facing edge 120 and an outer facing edge 122. The work surface 110 is removably attached to the wall segment frame 20 by hooks that fit into slots 24, 28 at the sides 22, 26 of the frame 20, and braces 123 that support the work surface 110 from below. Above the work surface 110 is a tool rail 126 that is removably attached to the wall segment by hooks that fit into slots 24, 28 at the sides 22, 26 of the wall segment frame 20. Above the tool rail 126 is an overhead cabinet 128 that is removably attached to the wall segment by hooks that fit into slots 24, 28 at the sides 22, 26 of the wall segment frame 20.

The exterior surface 40 (the left side) of the wall segment has been provided with a first sheet 52 that has been installed over a lower portion thereof. Note that a first sheet 52 is able to be positioned between the rearmost extent of the braces 123 (which are connected to the sides of the frame) and the exterior surface 40. That is, the braces 123 do not have to be disconnected and in order to install the first sheet 52. This allows the sides of the sheet 52 to be partially retained by the braces 123. The top and bottom edges of the first sheet 52 are affixed to the existing exterior surface 40 by way of fasteners 69, preferably in the form of double backed adhesive tape, construction adhesive, glue, or their equivalents (see, in particular the lower inset of FIG. 2) to secure the sheet 52 to the exterior surface 40. Continuing on, a second sheet 70 is being installed over an upper portion of the exterior surface 40 of the wall segment 10. As depicted, the sheet 70 is being inserted behind the tack board 124 and will be inserted between the inner facing edge of the work surface 110 and the exterior surface 40. Note, as with the braces 123 described above, the second sheet 70 can be installed over the exterior surface 40 in-situ, so that the tack board and work surface need not be removed. As with the first sheet, the top and bottom edges of the second sheet 70 are provided with fasteners 89, preferably in the form of double backed adhesive tape, construction adhesive, glue, staples, barbed attachment clips, or their equivalents (see, in particular the lower inset of FIG. 2) to secure the sheet 70 to the exterior surface 40. It will be understood that additional sheets may be used without departing from the spirit and scope of the invention. Moreover, it will also be understood that the sheets may be oriented so that their longitudinal axes are vertical.

As depicted in FIGS. 1 and 2, the exterior surface 42 (the right side) of the wall segment has been provided with a third sheet 90 that has been installed over a substantial portion of the exterior surface 42. Installation of the third sheet 90 was similar to the installation of the second sheet; that is, from above. Thus, the sheet 90 has been inserted between the overhead cabinet 128 and the exterior surface 42, between the tool rail 126 and the exterior surface 42, between the inner facing edge of the work surface 110 and the exterior surface 42, and behind the rearmost portions of braces 123. As with the first and second sheets, the top and bottom edges of the third sheet 90 are affixed to the existing exterior surface 42 by way of fasteners 109, preferably in the form of double backed adhesive tape, construction adhesive, glue, staples, clips, tacks, or their equivalents (see, in particular the lower inset of FIG. 2).

The thickness 57, 75, 95, of each sheet 52, 70, 90 is defined by the first and second surfaces, and is preferably approximately 0.125 inches (3.175 mm) or less, and greater than approximately 0.166 inches (1.587 mm). Each sheet 52, 70, 90 may be fire retardant, paramagnetic, capable of use with dry or wet markers, reflective, penetrable (tackable) so as to be able to receive push-pins of the like, or combinations thereof. A preferred material used for the sheets is molded fiberglass, however it will be understood that other materials can be used without departing from the spirit and scope of the invention. Optionally, each sheet 52, 70, 90 or substrate may be provided with a finishing layer 66, 86, 106, of material that includes the same properties of the sheets mentioned above, or which may include other properties, for example, such as acoustical dampening or electrical grounding. A preferred finishing layer is woven material or fabric that is glued to each sheet. More preferably, the woven material is made from recycled materials. It will be understood that if such a finishing layer is used, the total thickness 68, 88, 108 of the sheet and the finishing layer will be preferably approximately 0.125 inches (3.175 mm) or less.

As will be apparent to the practitioner in the art, the present invention is advantageous because a work station need not be replaced with a completely new work station. The present invention significantly extends the lifetime of an existing work station or cubicle before it is relegated to a landfill. The present invention substantially reduces the amount of time needed to refurbish a work station or cubicle, and each work station or cubicle may be customized. In addition, the present invention is beneficial because it uses recycled products and presents a smaller carbon footprint.

A preferred method of refurbishing an exterior surface of a wall segment using a single sheet will now be described. Preliminarily, the height and width of the wall section is been measured and a sheet is then trimmed to size and provided with a desired surface. As will be understood, the particular the surface chosen is up to an individual and can be, for example, woven material having a particular desired texture and color. The sheet is then provided with suitable fastening element(s), preferably double-backed adhesive strips, construction adhesive, staples, tacks or barbed clips. To attach the sheet using double-backed tape, adhesive, or similar material, the sheet is brought into position so that the inner surface of the sheet faces the exterior surface of the wall segment. The sheet is lifted up so that the bottom of the sheet is level with the bottom edge of the wall segment or clears the baseboard (if need be) of the wall segment and the bottom edge of the sheet is affixed to the wall segment. The sheet is then pivoted about the bottom edge connection and the remaining edges of the sheet are pressed against the wall segment; firmly securing the sheet into place on the wall segment. To attach the sheet using barbed attachment clips, one or more clips are attached to the exterior surface of the wall segment, preferably spaced-apart and close to the upper edge of the wall segment so that exposed tines extend upwardly and away from the clips. Then the upper edge of the sheet is positioned over the clips and pushed down and towards the wall segment so that the sheet is engaged by the tines. The bottom of the sheet may then be attached to the wall segment using double-backed tape and/or adhesive. Alternatively, barbed attachment clips can be used along the upper and lower edges of the wall segment.

In another preferred method of refurbishing an exterior surface of a tall wall segment, two sheets are used to refurbish an exterior surface of a wall segment. Preliminarily, the height and width of the wall section is measured and the sheets trimmed and provided with desired surfaces, as with the previous method.

As will be appreciated, differently sized sheets and sheets with different surfaces may be used without departing from the spirit and scope of the invention. For example, the dimensions of the sheets may be approximately the same size. Or, each sheet may be provided with a different surface that has a different color. Or, each sheet may be provided with material that has different properties such as acoustic dampening, fire retardation, paramagnetism, tackability, the ability to receive temporary dry or wet markings, light reflectivity, or combinations thereof. It will be further that each sheet may be further customized in a similar manner as discussed above.

The sheets are then provided with suitable fastening element(s), preferably double-backed adhesive strips, construction adhesive (or mastic), staples, tacks or barbed attachment clips. In practice, a first or larger of the two sheets is brought into position so that the inner surface of the sheet faces the exterior surface of the wall segment. The sheet is lifted up so that the bottom edge of the sheet is level with the bottom edge of the wall segment or clears the baseboard (if need be) of the wall segment and the bottom edge of the sheet is affixed to the wall segment. The sheet is then pivoted about the bottom edge connection and the side edges of the sheet (which are provided with fastening elements) are pressed against the wall segment; firmly securing the sheet into place on the wall segment. The upper edge of the first or larger sheet may be provided with additional fastening element(s), if desired. Note that the first sheet only partially covers the exterior surface of the wall segment. The remaining portion of the wall segment is covered with a second (usually smaller) sheet. In practice, the second sheet is brought into position above the first sheet so that its bottom edge is adjacent the top edge of the first sheet, and affixed to the wall segment using one or more fasteners or fastening elements of the type described above.

A preferred method of refurbishing an interior surface of a wall segment will now be described. In this method, two sheets are used to refurbish an interior surface of a wall segment that has a horizontal work surface such as a desk top. Preliminarily, the height and width of the wall section is measured and the sheets are trimmed and provided with desired surfaces. As will be understood, the surface chosen for both upper and lower sheets can be any desired texture or material mentioned above.

After the sheets have been prepared, the first of the two sheets is brought into position so that the inner surface of the first sheet faces the interior surface of the wall segment. The sheet is lifted up so that the bottom of the sheet clears the top surface of a horizontal load support (desk top). The sheet is then inserted into the space between the interior surface of the wall segment and the inner facing edge of the horizontal load support. The sheet is then slid downwardly until the desired amount of the inner surface of the wall segment is covered (this is usually when the bottom edge of the first sheet abuts the top edge of a base board, but it could also be located above the top edge of the base board or on the floor). At this point, the first sheet may be affixed to the wall segment at its edges using fastening elements such as double-backed tape, staples, tacks, barbed clips, construction adhesive, or combinations of tape, clips and adhesive. Note, in some instances, the first sheet may have a height that is suitable for refurbishing an entire wall segment. However, in instances where the first sheet is shorter than a wall segment to be covered, a second sheet may be used to cover the remaining wall segment, if desired. After the first, larger sheet has been installed, the second sheet is brought into position so that its bottom edge is adjacent the top edge of the first sheet, and affixed to the wall segment using one or more fasteners or fastening elements of the type described above.

Another similar method of refurbishing an interior surface of a wall segment is depicted in FIGS. 3-6. In this method, two sheets 52, 70 are used to refurbish an interior surface of a wall segment 10 of the type having solid lower portion and an upper portion with a view port. In that regard, note that the sheets 52, 70 can be used to change the character and function of the wall segment 10 being refurbished by obscuring the view port. The refurbishing steps are similar to the installation steps described above. That is, after the sheets 52, 70 have been prepared, they are positioned and attached to a wall segment. Prepared sheet 52 includes a first or inner surface 54, a second or exterior surface 56, side edges 58 and 60, a top edge 62 and a bottom edge 64. Similarly, prepared sheet 70 includes a first or inner surface 72, a second or exterior surface 74, side edges 76 and 80, a top edge 82 and a bottom edge 84. Initially, the first of the two sheets is brought into position so that a first or inner surface 54 of the first sheet 52 faces the interior surface 40 of the wall segment 10. The sheet 52 is lifted up so that the bottom edge 64 of the sheet 52 clears the top surface 112 (FIG. 1) of a horizontal load support (desk top) 110. The sheet 52 is then inserted into the space between the interior surface 40 of the wall segment 10 and the inner facing edge 122 (FIG. 2) of the horizontal load support 110 (best depicted in FIGS. 4 and 5). The sheet 52 is then slid downwardly until the desired amount of the inner surface 40 of the wall segment 10 is covered (this is usually when the bottom edge of the first sheet abuts the top edge of a base board, but it could also be located above the top edge of the base board or on the floor, not shown). At this point, the first sheet 52 may be affixed to the wall segment 10 at its edges 58, 60, 62, 64 using fastening elements such as double-backed tape, staples, tacks, barbed clips, construction adhesive, or combinations thereof (see, FIG. 2). After the first, larger sheet 52 has been installed, second sheet 70 is brought into position so that its bottom edge 84 is adjacent the top edge 62 of the first sheet 52, and affixed over the view port of the wall segment using one or more fasteners or fastening elements of the type described above. Note that the widths of the sheets are sized to fit between vertical attachment slots in external frame of the wall segment. This allows the sheets to be affixed to an existing wall segment without having to remove and replace any existing accessory such as a horizontal support surface (desk top), tack board, tool rail, book shelf, cabinet, overhead storage bin, etc. (see FIG. 2). It will be understood that additional sheets may be used, if desired.

Figure 7:
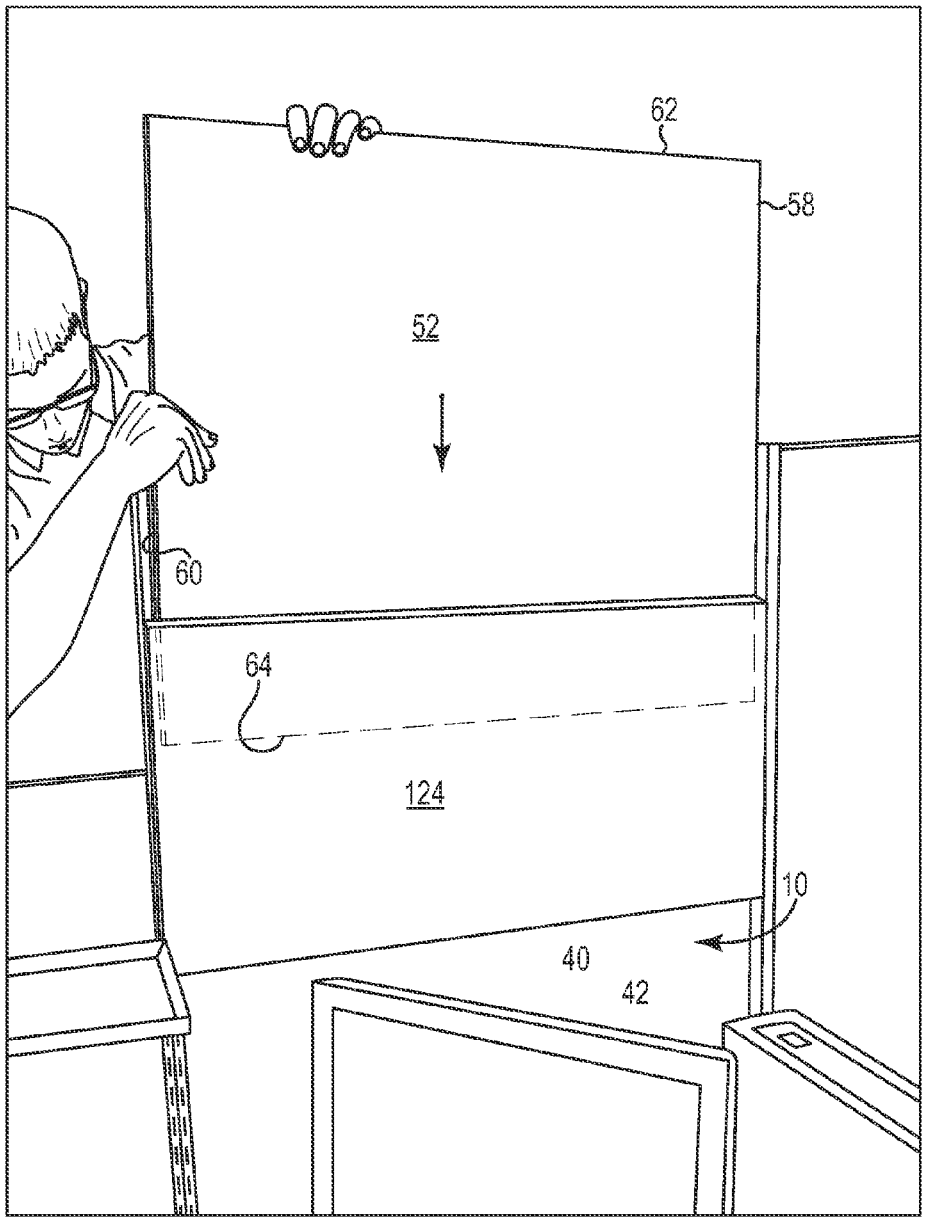

FIG. 7 illustrates, in greater detail, a refurbishing sheet 52 used to refurbish an interior surface 40 (42) of vertical wall segment 10. In FIG. 7, a sheet 52 is being installed on a wall segment 10 that has vertical support 124 in the form of a tack board. In this figure, a lower portion of the sheet 52 has already been inserted between the interior surface of the wall segment and the tack board so that the bottom edge 64 is obscured by the support 124. The sheet 52 will continue to be slid downwardly until the top edge 62 is substantially flush with the top edge of the wall segment 10. Note that the side edges 58 and 60 will not interfere with the vertical attachment slots 24, 28 of the wall segment frame 20 (see also FIG. 1).

As mentioned above, one or more attachment clips may be used to attach an apparatus to a wall segment. An embodiment of a clip is a generally planar panel having first and second opposing surfaces and top, bottom and side edges. The panel is generally rectangular and includes a longitudinal axis. However, other shapes are possible without departing from the spirit and scope of the invention. Each surface of the panel includes one or more engagement tines or barbs that are angled with respect to their respective surface. The angles have a range of approximately 10 degrees to approximately 45 degrees. Preferably, the angles had a range of approximately 30 to approximately 38 degrees. As depicted, the tines or barbs point in opposite directions from each opposing surface and define an intersecting plane with the panel. Each tine includes a tip that is configured so as to be able to penetrate into a wall segment or an apparatus, as the case may be. The clip can be manipulated by hand, but can also be manipulated by a tool, which engages the clip at a tool engagement portion of the clip. In use, a clip may be installed onto an existing wall segment by orienting tines on one of the clip's surfaces so that they point downwardly and then driving the clip into the wall segment. This positions the tines on the other side of the clip so that they are pointing upwardly. An apparatus can then be attached to the wall segment by driving the apparatus onto the upwardly pointing tines in a general downward motion. This, in effect, hangs the apparatus onto a wall segment.

The foregoing is considered as illustrative only. Furthermore, since numerous modifications and changes will readily occur to those skilled in the art, the exact construction and operation shown and described is only an example of a preferred embodiment. The invention is defined by the following claims.

What is claimed is:

1. A method of refurbishing a work station of the type having a vertical wall segment with a frame having a top, a bottom, side margins, and an exterior surface that is secured to the frame, the exterior surface extending from the top to the bottom and between the side margins of the frame, and a horizontal load support with an inner edge, with the horizontal load support connected to the side margins of the frame so that the inner edge of the horizontal load support faces the exterior surface of the vertical wall segment and defines a space therebetween, the method comprising the steps of:

a. providing a sheet of material having a first surface, a second surface, side edges, a top edge, a bottom edge, a thickness defined by the first and second surfaces, and a width defined by the side edges, with the thickness of the first sheet less than the distance defined by the edge of the horizontal work surface and the exterior surface of the work station, and with the width of the first sheet less than a distance defined by the side margins of the frame;

b. positioning the sheet so that it overlays the exterior surface and at least partially extend into the space defined by the inner edge of the horizontal load support and the vertical wall segment;

c. affixing the sheet to the wall segment.

2. The method of claim 1, wherein the step of affixing the sheet to the wall segment comprises adhering the sheet to the wall segment.

3. A method of refurbishing a work station of the type having a vertical wall segment with a frame having a top, a bottom, side margins, and two exterior surfaces that are secured to the frame, each exterior surfaces being substantially planar and extending from the top to the bottom and between the side margins of the frame, each exterior surface having a height dimension and a width dimension, and a load support with an edge, the load support connectable to the side margins of the frame so that the edge of the load support faces one of the exterior surfaces of the vertical wall segment in a spaced apart relation and defines a space therebetween, the method comprising the steps of:

a. measuring the height and width dimensions of one of the exterior surfaces of the vertical wall segment;

b. selecting a sheet of material having a first surface, a second surface, a thickness of approximately ⅛ inch or less, a height, and a width;

c. trimming the sheet so that the height and the width are substantially the same height and width of the exterior surface;

d. inserting the sheet at least partially through the space defined by the edge of the load support and the vertical wall segment; and, e. affixing the sheet to the exterior surface using a fastener.

4. The method of claim 3, wherein the step of trimming the sheet so that the height and the width are substantially the same height and width of the exterior surface includes the additional steps of:

i. providing a layer of finishing material;

ii. trimming the layer of finishing material so that it is substantially the same size as the first sheet; and iii. attaching the layer of finishing material to the first sheet.

5. The method of claim 4, wherein the step of attaching comprises the step of using a fastener.

6. An apparatus suitable for refurbishing a work station of the type having a vertical wall segment that includes a frame having a top, a bottom, side margins and an exterior surface, the exterior surface being substantially planar and secured to the frame such that it extends from the top to the bottom and between the side margins of the frame, and with the vertical wall segment including a horizontal work surface with an edge, with the horizontal work surface connected to the side margins of the frame so that the edge of the horizontal work surface faces the exterior surface of the vertical wall segment and defines a space therebetween, the apparatus comprising:

a first sheet of material having a first surface, a second surface, side edges, a top edge, a bottom edge, a thickness defined by the first and second surfaces, and a width defined by the side edges with the thickness of the first sheet less than the distance defined by the edge of the horizontal work surface and the exterior surface of the work station, and with the width of the first sheet less than a distance defined by the side margins of the frame;

wherein the sheet is movably positionable so that it is able to overlay the exterior surface and extend at least partially through the space defined by the exterior surface of the vertical wall segment and the edge of the horizontal work surface that is while the horizontal work surface remains connected to the vertical wall segment of the work station.

7. The apparatus of claim 6, wherein the first sheet has a thickness of approximately 1/16 inch to approximately ⅛ inch.

8. The apparatus of claim 6, wherein the first sheet has a thickness of approximately ⅛ inch or less.

9. The apparatus of claim 6, wherein the first sheet comprises tackable material.

10. The apparatus of claim 6, wherein the first sheet comprises fiberglass.

11. The apparatus of claim 6, further comprising a fastener that connects the first sheet to the vertical wall segment.

12. The apparatus of claim 6, further comprising a layer of material that is attached to the first surface of the first sheet, with the layer substantially covering the first surface of the first sheet.

13. The apparatus of claim 12, wherein the first sheet and the layer have a combined thickness of approximately 1/16 to approximately ⅛ inch.

14. The apparatus of claim 12, wherein the first sheet and the layer have a combined thickness of approximately ⅛ inch or less.

15. The apparatus of claim 12, wherein the layer is selected from the group consisting of: sound absorbing material, woven material, woven material formed from substantially recycled material or fire resistant material.

16. The apparatus of claim 6, further comprising a second sheet of material having a first surface, a second surface, side edges, a top edge, a bottom edge, and a thickness defined by the first and second surfaces, with the thickness of the second sheet is equal to or less than the thickness of the first sheet, with the second sheet positionable over a portion of the exterior surface not covered by the first sheet.

17. The apparatus of claim 16, further comprising a third sheet of material having a first surface, a second surface, side edges, a top edge, a bottom edge, and a thickness defined by the first and second surfaces, with the thickness of the second sheet is equal to or less than the thickness of the first sheet.

18. The apparatus of claim 17, wherein the third sheet is configured and arranged to be affixed to a second exterior surface of the wall segment.

19. In combination, a work station of the type having a vertical wall segment with a frame having a top, a bottom, side margins and first and second exterior surfaces that are secured to the frame, the exterior surfaces being parallel and substantially planar, with each exterior surface extending from the top to the bottom and between the side margins of the frame, and a horizontal load support with an edge, with the horizontal load support connected to the side margins of the frame so that the edge of the horizontal load support faces the first exterior surfaces of the vertical wall segment and defines a space therebetween, and an apparatus, the apparatus comprising:

a first sheet of material having a first surface, a second surface, side edges, a top edge, a bottom edge, a thickness defined by the first and second surfaces, and a width defined by the side edges, with the thickness of the first sheet equal to or less than the distance defined by the edge of the horizontal load support and the exterior surface of the work station, with the width of the first sheet less than a distance defined by the side margins of the frame, with the first sheet movably positionable so that it is able to overlay the first exterior surface and extend at least partially through the space defined by the first exterior surface of the vertical wall segment and the edge of the horizontal load support that is connected to the frame.

20. The combination of claim 19, further comprising a second sheet of material having a first surface, a second surface, side edges, a top edge, a bottom edge, and a thickness defined by the first and second surfaces, with the thickness of the second sheet is equal to or less than the thickness of the first sheet, with the second sheet positioned over the second exterior surface of the wall segment.

* * * * *